US006394754B1

(12) United States Patent
Choi

(10) Patent No.: US 6,394,754 B1
(45) Date of Patent: May 28, 2002

(54) AXIAL FLOW FAN

(75) Inventor: Mu Yong Choi, Seoul (KR)

(73) Assignee: LG Electronics, Co. Ltd., Seoul (KR)

( * ) Notice: Subject to any disclaimer, the term of this patent is extended or adjusted under 35 U.S.C. 154(b) by 4 days.

(21) Appl. No.: 09/629,107

(22) Filed: Jul. 31, 2000

(30) Foreign Application Priority Data

Nov. 2, 1999 (KR) ..... 99/48205

(51) Int. Cl.[7] ..... F01D 5/18
(52) U.S. Cl. ..... 416/238; 416/223 R; 416/DIG. 2
(58) Field of Search ..... 416/238, 223 R, 416/243, DIG. 2, 179, 182, 185; 415/119

(56) References Cited

U.S. PATENT DOCUMENTS 4,657,478 A * 4/1987 LaZebnik et al. ..... 415/126
5,221,187 A * 6/1993 Lorea et al. ..... 416/DIG. 2
5,297,931 A * 3/1994 Yapp et al. ..... 416/223 R
5,513,951 A * 5/1996 Komoda et al. ..... 416/223 R
6,164,919 A * 12/2000 Vanmoor ..... 416/243
6,213,718 B1 * 4/2001 Hill et al. ..... 416/146 R
6,238,184 B1 * 5/2001 Giribaldi ..... 416/223 R
6,287,078 B1 * 9/2001 Min et al. ..... 416/DIG. 2

FOREIGN PATENT DOCUMENTS

JP 02001059499 A * 7/2000

* cited by examiner

*Primary Examiner*—Edward K. Look
*Assistant Examiner*—James M McAleenan
(74) *Attorney, Agent, or Firm*—Birch, Stewart, Kolasch & Birch, LLP

(57) ABSTRACT

An axial flow fan, used for cooling the compressor and the condenser within the machine compartment of a refrigerator, is disclosed. This axial flow fan delivers an adequate volume of air to the machine compartment, and effectively reduces operational noise of the refrigerator. The axial flow fan has a hub mounted to the rotating shaft of a motor, with a plurality of blades regularly fixed around the hub, with the number of the blades being three and a diameter ratio of the inner diameter of the axial flow fan, equal to a hub diameter, to the outer diameter of the fan being set to 0.21~0.25. In addition, the axial flow fan of this invention has a large sweep angle, a large pitch angle and a high camber ratio.

4 Claims, 9 Drawing Sheets

AXIAL FLOW FAN

BACKGROUND OF THE INVENTION

1. Field of the Invention

The present invention relates, in general, to an axial flow fan for refrigerators, used for cooling the machines set within the machine compartment of a refrigerator, and, more particularly, to an axial flow fan for refrigerators, designed to have three blades, a diameter ratio of 0.21 to 0.25, a large sweep angle, a large pitch angle and a high camber ratio, thus forming a smooth air circulation within the machine compartment and more effectively cooling the machines within the machine compartment.

2. Description of the Prior Art

FIG. 1 is a perspective view showing the construction of a conventional side-by-side type refrigerator. FIG. 2 is a perspective view, showing the interior construction of the conventional side-by-side type refrigerator, and a cool air current within the refrigerator. FIG. 3 is a left-side view of FIG. 2. FIG. 4 is a right-side view of FIG. 2. FIG. 5 is a plan view, showing the interior construction of the machine compartment of a conventional refrigerator and a cool air current within the compartment. FIG. 6 is a front view of FIG. 2.

As shown in FIGS. 1 to 4, the cabinet of a conventional side-by-side type refrigerator is vertically partitioned into two vertical sections in its interior, thus defining a freezer compartment 10 within one of the two vertical sections and a fresh compartment 20 within the other vertical section.

In the above refrigerator, an evaporator 11 is installed in the rear portion of the freezer compartment 10 and generates cool air through a heat exchanging process. A cool air supply fan 13 is installed above the evaporator 11 and provides suction for drawing the cool air from the evaporator 11 and supplying the cool air into both the freezer compartment 10, and the fresh compartment 20.

In the lower section of the cabinet of the above refrigerator at a position under the two compartments 10 and 20, is an equipment compartment 21, in which a variety of equipment, such as a compressor 22, a condenser 23 and an axial flow fan 25, are located. As well known to those skilled in the art, the compressor 22 is used for compressing refrigerant for the refrigeration cycle, the condenser 23 condenses the compressed refrigerant from the compressor 22 through a heat exchanging process, and the axial flow fan 25 is used for cooling both the compressor 22 and the condenser 23 using an air current.

The above axial flow fan 25 is firmly mounted to the rotating shaft of a drive motor 26, and is rotated in conjunction with the motor 26. A shroud 27 is installed around the blades of the axial flow fan 25 to protect the blades.

In an operation of such a conventional side-by-side type refrigerator, refrigerant is compressed by the compressor 22 to become high temperature and high pressure gas refrigerant, and flows into the condenser 23. In the condenser 23, the gas refrigerant dissipates heat into the surrounding air and becomes liquid refrigerant acquiring the room temperature, and a high pressure.

The liquid refrigerant is, thereafter, output from the condenser 23 to pass through a capillary tube while being reduced in pressure, thus partially becoming two-phased refrigerant including a liquid phase and a gas phase. The refrigerant flows from the capillary tube into the evaporator 11 within the freezer compartment 10 and is completely vaporized within the evaporator 11 to become low pressure gas refrigerant while receiving heat from air surrounding the evaporator 11, thus cooling the air.

The cool air, formed through a heat exchanging process of the evaporator 11, is supplied into both the freezer compartment 10 and the fresh compartment 20. The above-mentioned refrigeration cycle is repeated to keep the two compartments 10 and 20 at desired low temperatures.

During such an operation of the refrigerator, the axial flow fan 25 installed in the machine compartment 21 cools both the compressor 22 and the condenser 23 using an air current.

The air current from the axial flow fan 25 flows within the machine compartment 21 as follows: Outside air, or atmospheric air is primarily introduced into the machine compartment 21 through an air inlet port 21 due to the suction force provided by the axial flow fan 25.

Within the machine compartment 21, the inlet air passes through the drive motor 26 by the suction force of the fan 25, and passes through both the fan 25 and the shroud 27 so as to reach the condenser 23.

The air passes, through the condenser 23 while absorbing heat dissipated from the refrigerant flowing within the condenser 23. Thus, the air cools the condenser 23.

After passing through the condenser 23, the air passes through the compressor 22, cooling the surface of the compressor's housing, prior to being discharged from the machine compartment 21 into the atmosphere through an air outlet port 21.

In a brief description, inlet air, sucked into the machine compartment 21 by the suction force of the axial flow fan 25, primarily cools the condenser 23, thus improving heat exchange efficiency of the condenser 23 and finally improving refrigeration efficiency of the refrigerator. The inlet air within the machine compartment 21 secondarily cools the external surface of the compressor 22, thus keeping the compressor 22 at a desired low temperature, and preventing deterioration of the operational performance of the compressor.

Therefore, the operational performance of the axial flow fan is one of the important factors determining the refrigeration efficiency, and the operational noise of the refrigerator.

Such a conventional axial flow fan 25 for refrigerators typically has three blades, an outer diameter of the fan 25 ranging from 145 mm to 165 mm, a small blade sweep angle, a small blade pitch angle, and a low blade camber ratio, causing a refrigerator to have low refrigeration efficiency, and to generate noise substantial enough to disturb individuals near the refrigerator.

A small blade sweep angle increases the undesirable operational noise of the fan 25. A small blade pitch results in a reduction in the width of the blades, therefore an axial flow fan such as fan 25 is not suitable to draw a desirable quantity of air. When the blade camber ratio (%) is as low as described above, it is almost impossible to effectively increase the static pressure of fluid passing through both the axial flow fan and the shroud. In order to overcome such a problem, the fan 25 has to be rotated at an exceedingly high rpm.

Therefore, it is necessary to optimally design a variety of blade designing factors, such as the number of blades, diameter ratio, sweep angle, pitch angle and camber ratio so as to allow the designing factors to agree with desired operational conditions of a refrigerator. When such designing factors of the axial flow fan are optimally designed as described above, it is possible to optimally operate the axial flow fan through an inverter control process while supplying a adequate quantity of air to both the compressor and the condenser and achieving an adequate rpm of the fan, and effectively reducing operational noise of the fan.

SUMMARY OF THE INVENTION

Accordingly, the present axial flow fan was invented having in mind the above problems occurring in the prior art, and an object of the present invention is to provide an axial flow fan for refrigerators, which is designed to allow air to actively circulate within the machine compartment of a refrigerator, thus accomplishing smooth inflow and outflow of air, and eliminating operational noise caused by disturbed air circulation within the machine compartment and increasing the quantity of inflow and outflow air, and delivering an adequate quantity of air to both the compressor and the condenser, and effectively reducing operational noise of the refrigerator.

In order to accomplish the above object, the preferred embodiment of the present invention provides an axial flow fan for refrigerators, comprising a hub mounted to the rotating shaft of a motor, with a plurality of blades regularly fixed around the hub. In the axial flow fan of this invention, a variety of blade designing factors, such as the number of blades, diameter ratio, sweep angle, pitch angle and camber ratio are optimally designed to allow the designing factors to agree with desired operational conditions of a refrigerator. This axial flow fan thus supplies an adequate quantity of air to both the compressor and the condenser within the machine compartment, while effectively reducing operational noise of the refrigerator.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
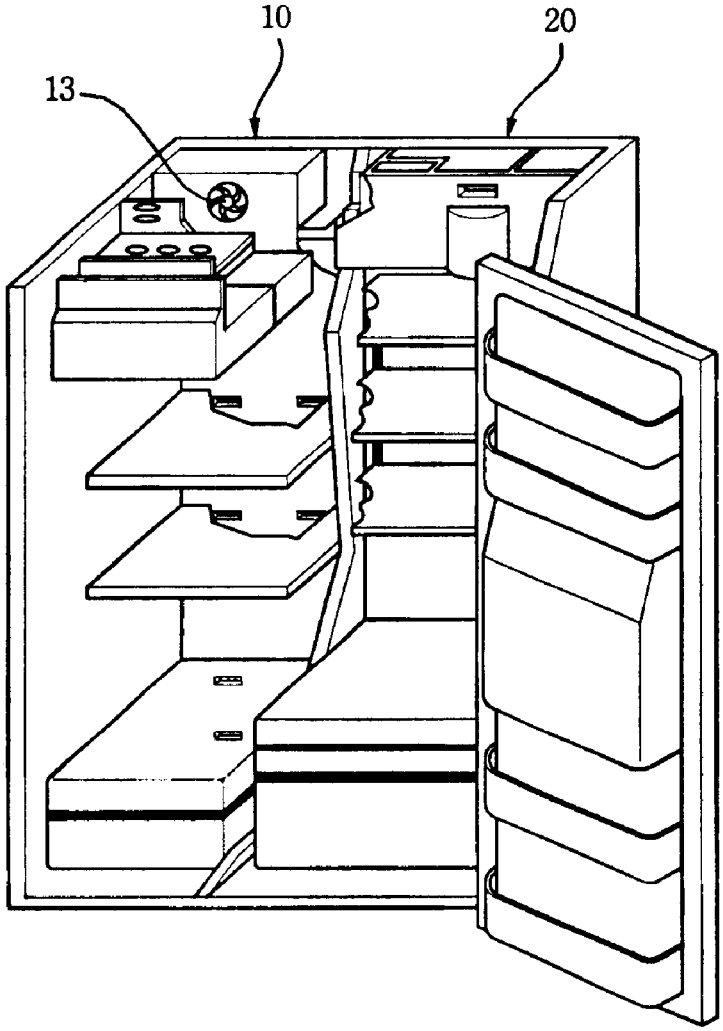
FIG.1 (Prior Art)
FIG. 1 is a perspective view, showing the construction of a conventional side-by-side type refrigerator.
Figure 2:
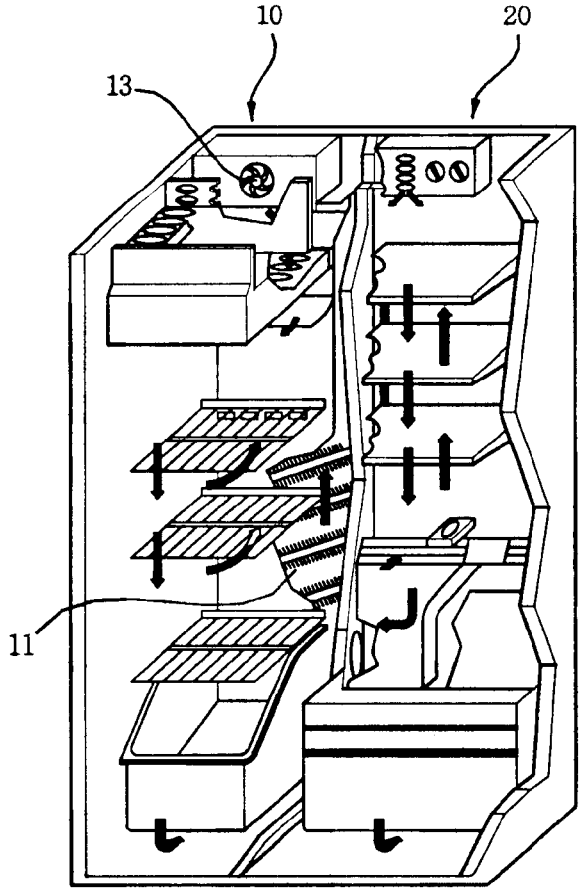
FIG.2 (Prior Art)
FIG. 2 is a perspective view, showing the interior construction of the conventional side-by-side type refrigerator and a cool air current within the refrigerator.
Figure 3:
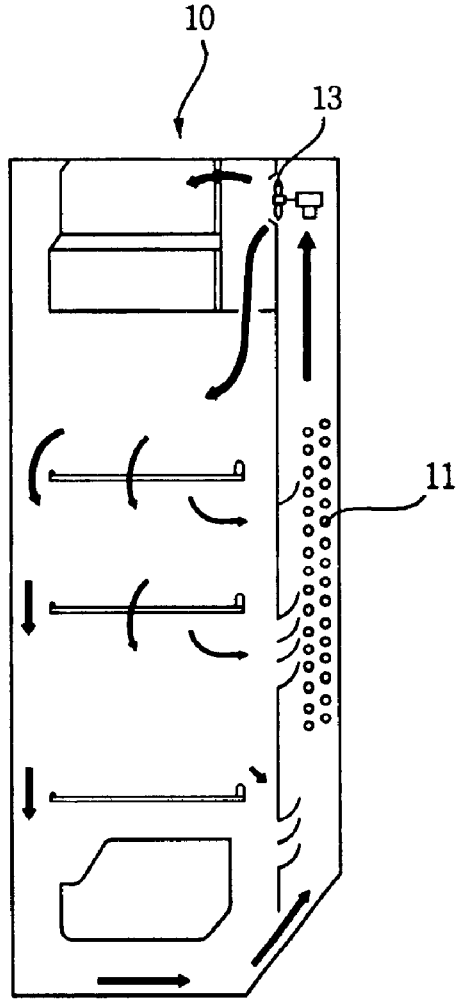
FIG.3 (Prior Art)
FIG. 3 is a left-side view of FIG. 2.
Figure 4:
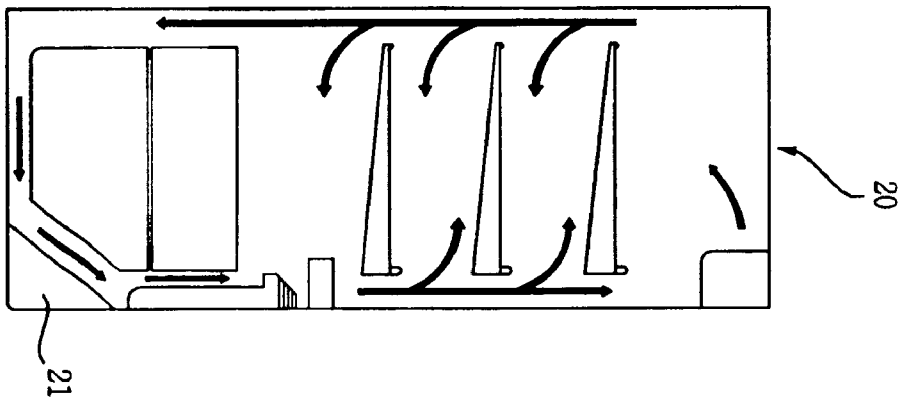
FIG.4 (Prior Art)
FIG. 4 is a right-side view of FIG. 2.
Figure 5:
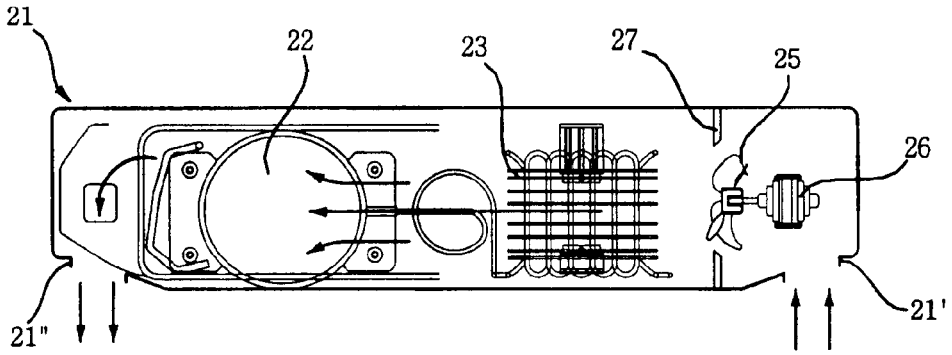
FIG.5 (Prior Art)
FIG. 5 is a plan view, showing the interior construction of the machine compartment of a conventional refrigerator and a cool air current within the compartment.
Figure 6:
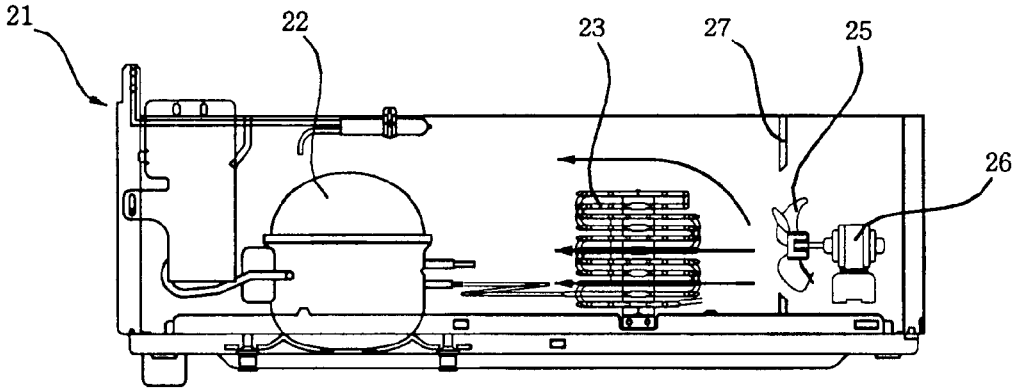
FIG.6 (Prior Art)
FIG. 6 is a front view of FIG. 2.
Figure 7:
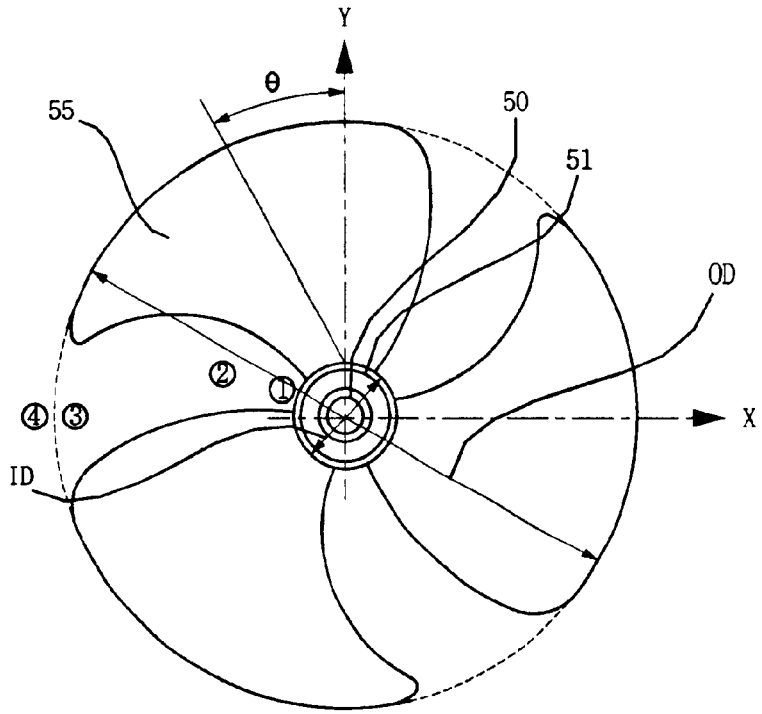
FIG. 7 is a front view of an axial flow fan for refrigerators in accordance with the preferred embodiment of the present invention.
Figure 8:
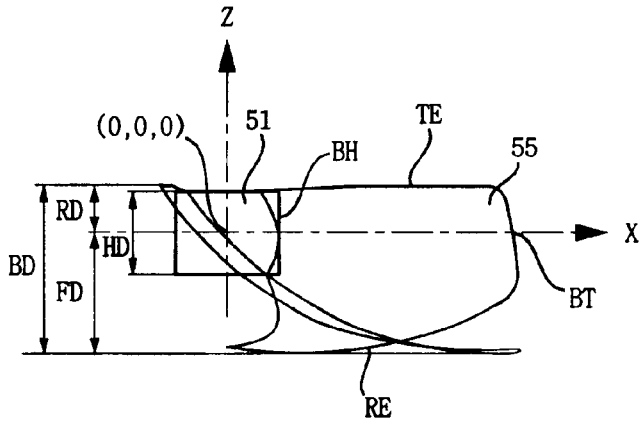
FIG. 8 is a side view of FIG. 7.
Figure 9A:
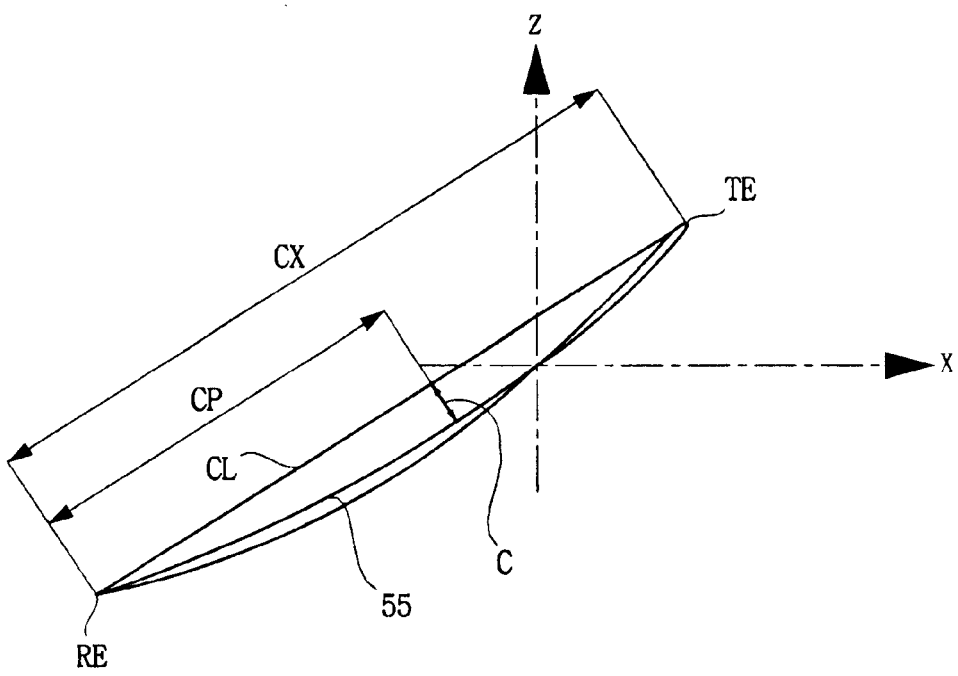
FIGS. 9*a* and 9*b* are sectional views, showing the shape of a blade included in the axial flow fan according to the preferred embodiment of this invention.
Figure 9B:
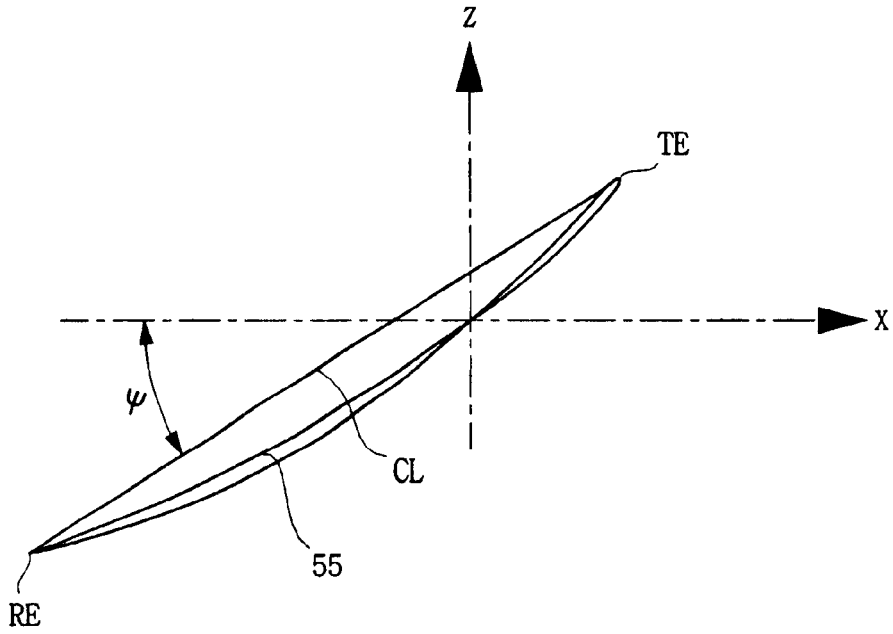

FIG. 7 is a front view of an axial flow fan for refrigerators in accordance with the preferred embodiment of the present invention. FIG. 8 is a side view of FIG. 7. FIGS. 9*a* and 9*b* are sectional views, showing the shape of a blade included in the axial flow fan according to the preferred embodiment of this invention.

In the present invention, the axial flow fan is designed to effectively draw atmospheric air into the machine compartment of a refrigerator, and primarily cools the condenser, thus improving the heat exchange efficiency of the condenser, and secondarily cools the external surface of the compressor, thus preventing the compressor from deteriorating in operational performance. As shown in FIGS. 7 to 9, the axial flow fan of this invention comprises a hub 51, which is firmly mounted to the rotating shaft 50 of a drive motor, with a plurality of blades 55 regularly fixed around the hub 51. In the axial flow fan of this invention, the number of the blades 55 is set to three, with a diameter ratio of the inner diameter ID of the axial flow fan to the outer diameter OD set from 0.21 to 0.25. In such a case, the inner diameter ID is equal to the diameter of the hub 51.

In a detailed description, the outer diameter OD of the axial flow fan is 150±1 mm, while the inner diameter ID of the fan is 35±1 mm. Therefore, the diameter ratio of the axial flow fan is 0.233. On the other hand, the front leading distance FD of the blades 55 is 43.5±1 mm, while the rear trailing distance RD of the blades 55 is 14.2±1 mm. In such a case, the rear trailing distance RD of the blades 55 is shorter than the hub thickness HD.

The front leading distance FD of the blades 55 is a distance on the Z-axis, or on a rotating axis extending from the center point (0, 0, 0) of a blade dater to the maximum blade leading edge RE, while the rear trailing distance RD of the blades 55 is a distance on the Z-axis, or on a rotating axis extending from the center point (0, 0, 0) of the blade dater to the maximum blade trailing edge TE. That is, the two distances FD and RD are commonly defined on the rotating axis (Z-axis) of the fan.

The center point (0, 0, 0) of the blade dater is positioned in the hub 51, and designates the center point of the straight line extending from the maximum blade leading edge RE to the maximum blade trailing edge TE of the blade hub BH.

In addition, the maximum camber position of each blade 55 is set from 0.7 to 0.75, with the camber positions being uniformly distributed on each blade 55 from the blade hub BH to the blade tip BT. The maximum camber ratio of each blade 55 is from 4.8 to 5.2 percent at the blade hub BH and from 6.1 to 6.5 percent at the blade tip BT while accomplishing a linear distribution on the blade 55.

In such a case, the maximum camber position of each blade 55 is located at a point on which the blade 55 is spaced furthest from the straight line CL extending from the blade leading edge RE to the blade trailing edge TE, and is indicated as a ratio of the length CP from the blade leading edge RE to the point of the straight line CL being spaced furthest from the blade 55 to cord length CX.

The distance between said straight line and said point on each blade 55 is the maximum camber C. The maximum camber ratio is a ratio of the maximum camber C to the cord length CL.

The pitch angle Ψ of each blade 55 is 43.8° to 44.2° at the blade hub BH and 29.8° to 30.2° at the blade tip BT while being linearly distributed on the blade 55 from the blade hub BH to the blade tip BT.

In such a case, the pitch angle Ψ of each blade 55 is an angle formed between the X-axis and a straight line extending between the blade leading edge RE to the blade trailing edge TE. That is, the pitch angle Ψ of each blade 55 expresses the slope of the blade 55 relative to a plane perpendicular to the rotating axis (Z-axis) of the fan.

The sweep angle θ of each blade 55 is 0.0° to 37.0° at a section from the blade hub BH to an intermediate point between the blade hub BH and the blade tip BT and 37.0° to 49.5° at another section from the intermediate point to the blade tip BT while being quadratic-parabolically distributed on the blade 55 from the blade hub BH to the blade tip BT.

The above sweep angle θ of each blade 55 is an angle formed between the Y-axis and a straight line extending between the center of the blade hub BH and the center of the blade tip BT, with the center of the blade hub BH being positioned on the Y-axis. That is, the sweep angle θ of each blade 55 expresses the tilt of the blade 55 in the rotating direction of the blades 55.

When the axial flow fan of this invention has such a high sweep angle θ, a high pitch angle Ψ and a high camber ratio, the fan desirably reduces its operational noise and has a wide blade width BD capable of increasing the air volume. In addition, it is possible to adequately and effectively increase the static pressure of air passing through both the fan and the shroud, and so the desired air volume of the fan may be accomplished with a low rpm of the fan.

On the other hand, the blade interval between the blades 55 is set to 8.0 mm at the position ①, 27.0 mm at the position ②, 16.0 mm at the position ③, and 27.0 mm at the position ④ as shown in FIG. 7. When setting the position of the blade hub BH on each blade 55 to zero (0.00) and the position of the blade tip BT to 1.00, the blade interval is primarily set to 8.0±1 mm at a position around the blade hub BH. On the other hand, the blade interval within the first positional section of 0 to 0.75 is quadratic-parabolically increased from 8.0±1 mm to 27.0±1 mm. In addition, the blade interval within the second positional section of 0.75 to 0.97 is quadratic-parabolically reduced from 27.0±1 mm to 16.0±1 mm. Within the third positional section of 0.97 to 1.00 including the blade tip BT, the blade interval is cubic-parabolically increased from 16.0±1 mm to 27.0±1.0 mm.

In a brief description, the blade intervals of 27.0mm and 16.0 mm are located at the positions of 0.75 and 0.97 of the extent from the blade hub BH to the blade tip BT. In such a case, the differentially derived function at the boundary points of 0.75 and 0.97 between the three sections is zero, while the blade interval distribution within the three sections forms quadratic and cubic-parabolic distributions.

In the axial flow fan for refrigerators in accordance with the preferred embodiment of this invention, it is most preferable to set the number of the blades 55 to three, the outer diameter OD of the blades 55 to 150 mm, the inner diameter ID of the blades 55 to 35 mm, the front leading distance FD of the blades 55 to 43.5 mm and the rear trailing distance RD of the blades 55 to 14.2 mm, with rear trailing distance RD of the blades 55 being shorter than the hub thickness HD.

On the other hand, it is most preferable to set the maximum camber position CP of each blade 55 to 0.73 while uniformly distributing the camber positions on each blade 55 from the blade hub BH to the blade tip BT. In addition, the maximum camber ratio of each blade 55 is most preferably set to 5.00% at the blade hub BH and 6.30% at the blade tip BT while accomplishing a linear distribution on the blade 55.

The pitch angle Ψ of each blade 55 is most preferably set to 44.00° at the blade hub BH and to 30.00° at the blade tip BT while accomplishing a linear distribution on the blade 55 from the blade hub BH to the blade tip BT.

The sweep angle θ of each blade 55 is set from 0.0° to 37.0° at the section from the blade hub BH to the intermediate point (Rt+Rh)/2 between the blade hub BH and the blade tip BT and from 37.0° to 49.5° at the other section from the intermediate point (Rt+Rh)/2 to the blade tip BT while being quadratic-parabolically distributed on the blade 55 from the blade hub BH to the blade tip BT.

In addition, the blade interval between the blades 55 is set to 8.0 mm at the position ①, 27.0 mm at the position ②, 16.0 mm at the position ③, and 27.0 mm at the position ④ as shown in FIG. 7.

FIGS. 10 to 13 are graphs showing operational noise of the axial flow fan of the invention as a function of a variety of designing factors of the fan.

Figure 10:
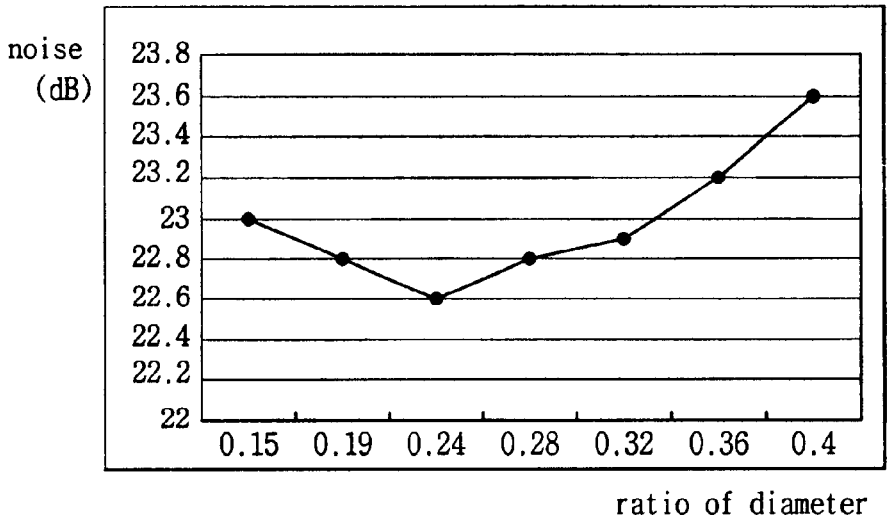
FIG. 10 is a graph showing operational noise of the axial flow fan according to the invention as a function of the diameter ratio of the axial flow fan.

That is, FIG. 10 is a graph showing operational noise of the axial flow fan as a function of the diameter ratio of the fan. This graph shows that it is possible to accomplish the desired minimum operational noise of 22.6 dB when the diameter ratio (ID/OD) of the inner diameter ID of the blades 55 (the diameter of the hub) to the outer diameter of the blades 55 is set from 0.2 to 0.25.

Figure 11:
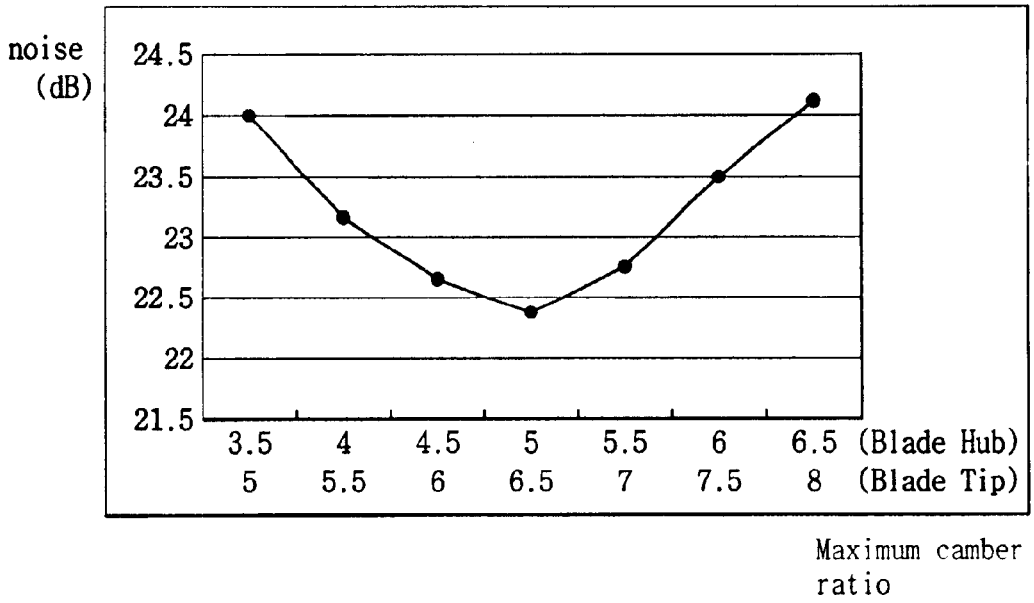
FIG. 11 is a graph showing operational noise of the axial flow fan according to the invention as a function of the maximum camber ratio of the axial flow fan.

FIG. 11 is a graph showing the operational noise of the axial flow fan as a function of the maximum camber position CP of the fan. This graph shows that it is possible to accomplish a desired minimum operational noise of 22.4±0.1 dB when the maximum camber ratio CP is set from 4.8 to 5.2 percent at the blade hub BH and from 6.1 to 6.5 percent at the blade tip BT while accomplishing a linear distribution on the blade 55 from the blade hub BH to the blade tip BT.

Figure 12:
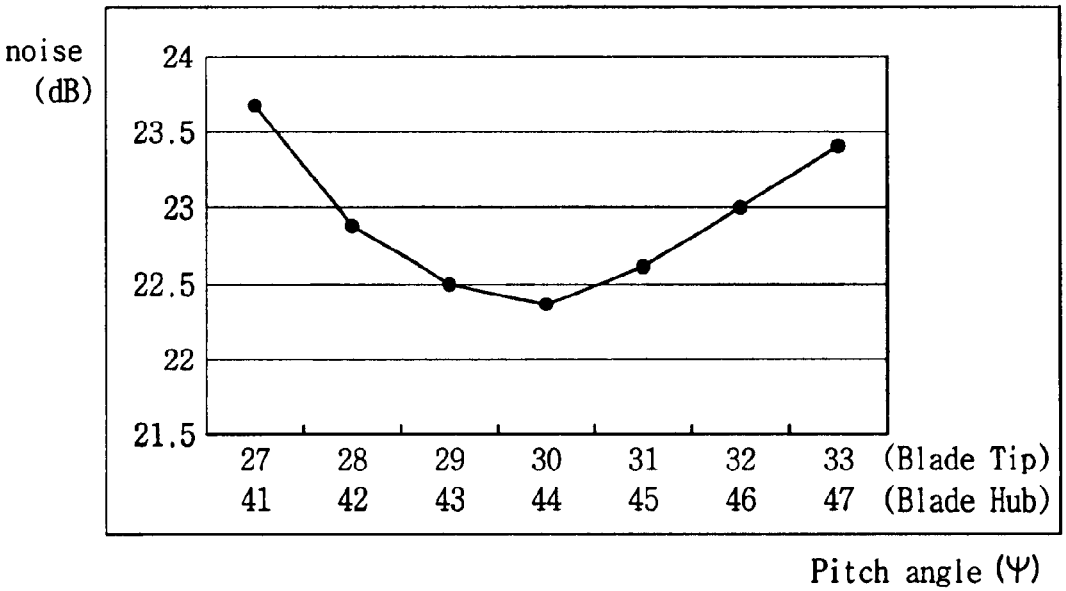
FIG. 12 is a graph showing operational noise of the axial flow fan according to the invention as a function of the pitch angle of the axial flow fan.

FIG. 12 is a graph showing the operational noise of the axial flow fan as a function of the pitch angle Ψ of the blades 55. This graph shows that it is possible to accomplish a desired minimum operational noise of 22.5±0.1 dB when the pitch angle Ψ of each blade 55 is set from 43.8° to 44.2° at the blade hub BH and from 29.8° to 30.2° at the blade tip BT while accomplishing a linear distribution on the blade 55 from the blade hub BH to the blade tip BT.

Figure 13:
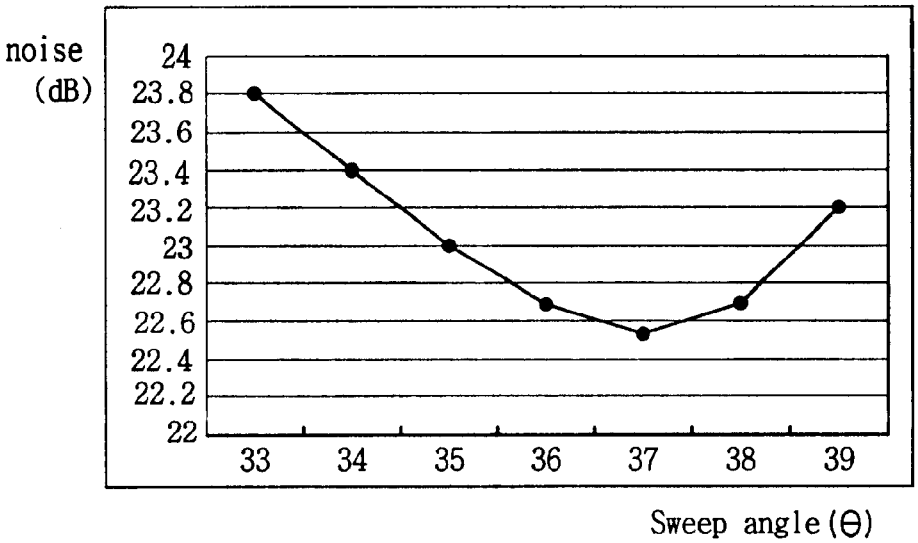
FIG. 13 is a graph showing operational noise of the axial flow fan according to the invention as a function of the sweep angle of the axial flow fan.

FIG. 13 is a graph showing operational noise of the axial flow fan as a function of the sweep angle θ of the blade 55. This graph shows that it is possible to accomplish a desired minimum operational noise of 22.5±0.1 dB when the sweep angle θ of each blade 55 is set from 0.0° to 37.0° at the section from the blade hub BH to the intermediate point between the blade hub BH and the blade tip BT and from 37.0° to 49.5° at the other section from the intermediate point to the blade tip BT while being quadratic-parabolically distributed on the blade 55 from the blade hub BH to the blade tip BT.

When the axial flow fan of this invention is used in a side-by-side type refrigerator, the operational noise of the refrigerator is remarkably reduced in comparison with a refrigerator having a conventional axial flow fan.

As described above, the present invention provides an axial flow fan for refrigerators. This axial flow fan is designed to have three blades, a diameter ratio of 0.21 to 0.25, a large sweep angle, a large pitch angle and a high camber ratio, thus forming a smooth air circulation within the machine compartment of a refrigerator and allowing air to actively circulate within the machine compartment. The axial flow fan of this invention thus accomplishes smooth inflow and outflow of air and eliminates operational noise caused by disturbed air circulation within the machine compartment, and increases the quantity of inflow and outflow air. This axial flow fan thus finally delivers a supply of a desired quantity of air to both the compressor and the condenser and effectively reduces operational noise of the refrigerator.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An axial flow fan, comprising a hub mounted to a rotating shaft, with a plurality of blades regularly fixed around said hub, wherein the number of said blades is three, an outer diameter of the axial flow fan is 150±1 mm, and an inner diameter of the fan being equal to a hub diameter is 35±1 mm, with a front leading distance of said blades being set to 43.5±1 mm, and a rear trailing distance of the blades being set to 14.2±1 mm.

2. The axial flow fan according to claim 1, wherein a maximum camber position of each of the blades is set from 0.7 to 0.75, with the camber positions being uniformly distributed on each blade from a blade hub to a blade tip and a maximum camber ratio of each blade being set from 4.8 to 5.2 percent at the blade hub and from 6.1 to 6.5 percent at the blade tip, while being linearly distributed on the blade from the blade hub to the blade tip.

3. The axial flow fan according to claim 1, wherein a pitch angle of each of the blades is set from 43.8° to 44.2° at a blade hub and from 29.8° to 30.2° at a blade tip while being linearly distributed on the blade from the blade hub to the blade tip.

4. The axial flow fan according to claim 1, wherein a sweep angle of each of the blades is set from 0.0° to 37.0° at a section from a blade hub to an intermediate point between said blade hub and a blade tip, and from 37.0° to 49.5° at another section from said intermediate point to said blade tip while being quadratic-parabolically distributed on the blade.

* * * * *